US011258201B2

(12) United States Patent
Hsiao et al.

(10) Patent No.: US 11,258,201 B2
(45) Date of Patent: Feb. 22, 2022

(54) UNLOCKING BRACKET OF CONNECTOR

(71) Applicant: HONGFUJIN PRECISION ELECTRONICS(TIANJIN)CO., LTD., Tianjin (CN)

(72) Inventors: Yi-Pei Hsiao, New Taipei (TW); Hsiang-Yu Lien, New Taipei (TW); Ya-Ting Lin, New Taipei (TW); Tung-Ho Shih, New Taipei (TW)

(73) Assignee: HONGFUJIN PRECISION ELECTRONICS(TIANJIN)CO., LTD., Tianjin (CN)

( * ) Notice: Subject to any disclaimer, the term of this patent is extended or adjusted under 35 U.S.C. 154(b) by 0 days.

(21) Appl. No.: 16/944,566

(22) Filed: Jul. 31, 2020

(65) Prior Publication Data

US 2021/0408726 A1 Dec. 30, 2021

(30) Foreign Application Priority Data

Jun. 24, 2020 (CN) ..... 202010591852.8

(51) Int. Cl.
*H01R 13/633* (2006.01)
*H01R 13/627* (2006.01)
*H01R 24/64* (2011.01)

(52) U.S. Cl.
CPC ..... *H01R 13/633* (2013.01); *H01R 13/6272* (2013.01); *H01R 24/64* (2013.01)

(58) Field of Classification Search
CPC ... H01R 13/633; H01R 13/6272; H01R 24/64
USPC ..... 439/344
See application file for complete search history.

(56) References Cited

U.S. PATENT DOCUMENTS 5,679,013 A * 10/1997 Matsunaga ..... H01R 13/453 439/144
6,273,761 B1 * 8/2001 Hsu ..... H01R 13/64 439/676
6,283,796 B1 * 9/2001 Yeh ..... H01R 13/645 439/676
6,296,528 B1 * 10/2001 Roberts ..... H01R 13/6456 439/676
6,312,293 B1 * 11/2001 Wang ..... H01R 13/6275 439/677
6,319,070 B1 * 11/2001 Tan ..... H01R 24/64 439/607.43
6,808,427 B1 * 10/2004 Xue ..... H01R 13/64 439/676
6,918,794 B2 * 7/2005 Wan ..... H01R 13/64 439/676

(Continued)

FOREIGN PATENT DOCUMENTS

TW 201315040 A1 4/2013

*Primary Examiner* — Alexander Gilman
(74) *Attorney, Agent, or Firm* — ScienBiziP, P.C.

(57) ABSTRACT

An unlocking bracket includes a fastener and an unlocking member. The fastener includes a fixing case and a support rod provided on the fixing case. The support rod is configured to bear on a connector. The fixing case is configured to sleeve on the connector. The unlocking member includes a cantilever and an unlocking block. The cantilever is configured to be rotationally mounted on the fixing case. The unlocking block is configured to abut a locking clip of the connector. The cantilever is configured to drive the unlocking block to rotate to push a locking clip of the connector.

8 Claims, 7 Drawing Sheets

(56) References Cited

U.S. PATENT DOCUMENTS 6,957,984 B1 * 10/2005 Huang ..... H01R 13/641
439/676
2013/0084731 A1 4/2013 Gong et al.

* cited by examiner

UNLOCKING BRACKET OF CONNECTOR

FIELD

The subject matter herein generally relates to connectors, and more particularly to an unlocking bracket for unlocking a connector.

BACKGROUND

RJ45 connector is a kind of connector in wiring systems. In some cases, designers need to set up specific network cards when there is limited space in the chassis. Due to space limitations, sometimes it is not possible to press a locking clip of a cable connector to disconnect the cable connector.

BRIEF DESCRIPTION OF THE DRAWINGS

Implementations of the present disclosure will now be described, by way of embodiments, with reference to the attached figures.

DETAILED DESCRIPTION

Figure 1:
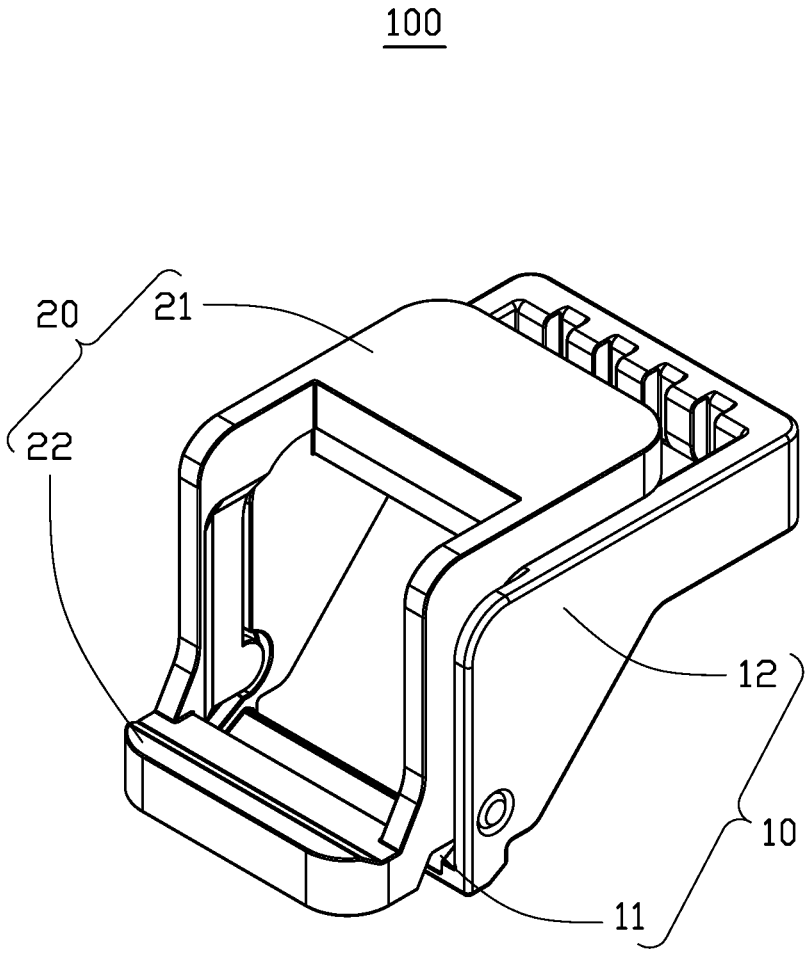
FIG. 1 is a schematic perspective view of an unlocking bracket according to a first embodiment.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or another word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series, and the like.

First Embodiment

Figure 3:
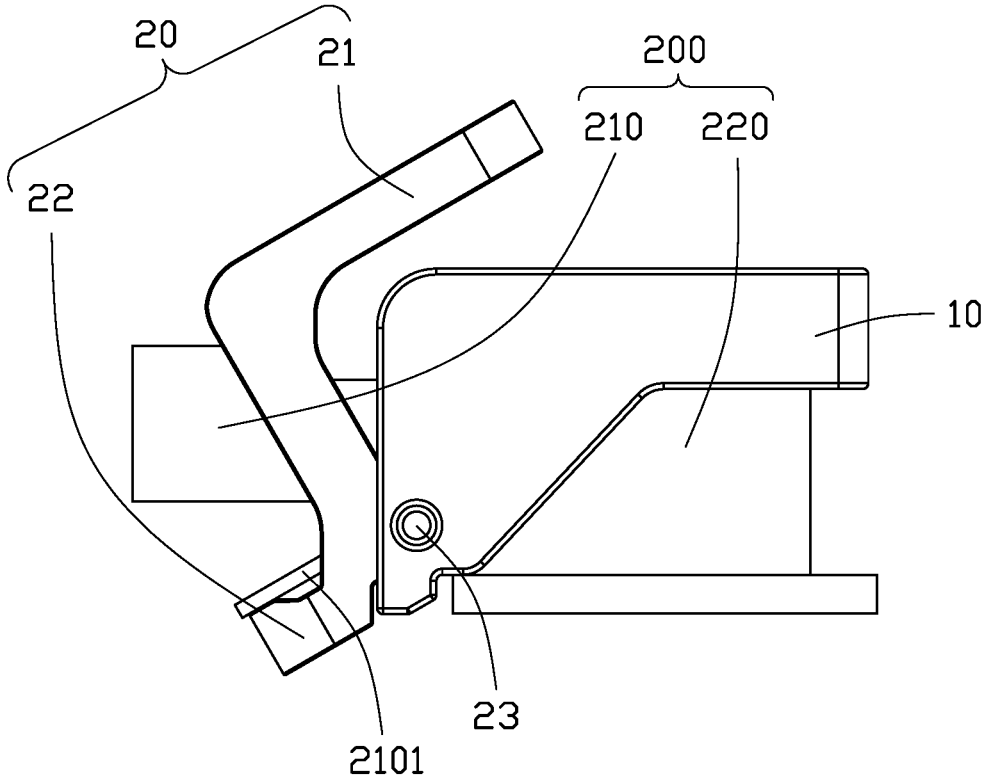
FIG. 3 is a schematic diagram of a locked state of the unlocking bracket and a connector.

Referring to FIG. 1, a first embodiment of an unlocking bracket 100 is provided for inserting and removing a connector 200 (shown in FIG. 3). The unlocking bracket 100 includes a fastener 10 and an unlocking member 20. The fastener 10 includes a fixing case 12 and a support rod 11 provided on the fixing case 12. The support rod 11 abuts the connector 200, and the fixing case 12 is sleeved on the connector 200. The unlocking member 20 includes a cantilever 21 and an unlocking block 22 provided on the cantilever 21. The cantilever 21 is rotationally provided on the fixing case 12. The unlocking block 22 resists a locking clip 2101 (shown in FIG. 3). The cantilever 21 drives the unlocking block 22 to rotate to push the locking clip 2101.

Figure 2:
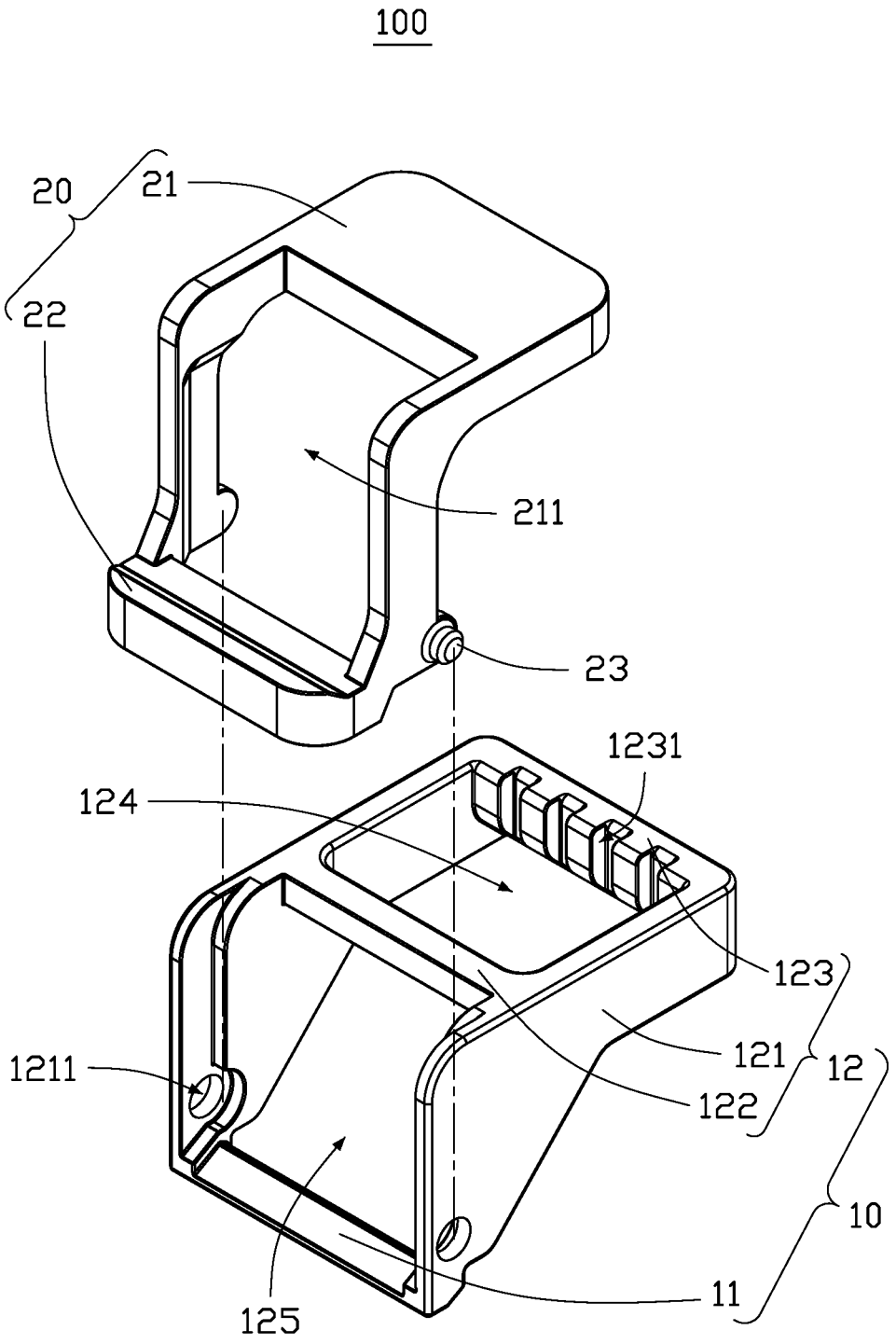
FIG. 2 is an exploded view of the unlocking bracket shown in FIG. 1.

Referring to FIG. 2, the support rod 11 is located on the fixing case 12. The support rod 11 abuts the connector 200, and the fixing case 12 is sleeved on the connector 200 to fix the connector 200.

The support rod 11 is in contact with a bottom of the connector 200 to form a support point with the connector 200 to facilitate the rotational installation of the fastener 10. In one embodiment, the length of the support rod 11 is equal to the width of a port of the connector 200. It should be noted that the type of the support rod 11 is not limited to this. In other embodiments, the support rod 11 may be a block structure, and there may be two support rods 11 symmetrically arranged on an inner wall of the fixing case 12 and extending inward along the inner wall of the fixing case 12 by a specified length.

The fixing case 12 includes two side plates 121, a limiting plate 122, and a fixing block 123. The two side plates 121 are symmetrically arranged on both ends of the support rod 11. The limiting plate 122 is fixed to inner walls of the two side plates 121 and located at an upper end of the side plates 121. The fixing block 123 is provided at ends of the two side plates 121.

The side plates 121 are clipped on outer walls of the connector 200, and the limiting plate 122 and the fixing block 123 fix the fixing case to the connector 200. It can be understood that the distance between the two side plates 121 is equal to the distance between the outer walls of the connector 200, and can be adjusted according to the distance between the outer walls of the connector 200.

Each side plate 121 defines a connecting hole 1211. The unlocking member 20 is rotationally mounted in the connecting holes 1211 and rotates about the connecting holes 1211 as an axis.

The limiting plate 122 is provided on an upper end of the fixing case 12 to define a position of an upper end of the connector 200 when the fixing case 12 fixes the port of the connector 200.

Two ends of the fixing block 123 are respectively provided on the two side plates 121, and the fixing block 123 extends radially downward from an upper end of the side plates 121 by a specified length to define an end position of the connector 200 when the fixing case 12 fixes the connector 200.

A plurality of anti-slip grooves 1231 is equidistantly defined in a side of the fixing block 123 facing the limiting plate 122 to prevent the fixing block 123 from slipping when the fixing case 12 is rotationally mounted on the connector 200.

The fixing case 12 defines a latching slot 124, and the connector 200 is locked in the latching slot 124.

The fixing case 12 further defines an opening 125 communicating with the latching slot 124, and the connector 200 extends out of the opening.

Referring to FIG. 2, the unlocking member 20 includes a cantilever 21 and an unlocking block 22 provided on the cantilever 21. The cantilever 21 is located above the fastener 10, and the unlocking block 22 abuts the locking clip 2101.

The cantilever 21 is used to drive the unlocking block 22 to rotate, so that the unlocking block 22 lifts the locking clip 2101. In one embodiment, the cantilever 21 is a perpendicular plate structure, so that when the unlocking member 20 lifts the locking clip 2101, the cantilever 21 is attached to the fastener 10, thereby preventing a gap between the cantilever 21 and the fastener 10 and damage to the unlocking member 20 due to excessive pressing. It should be noted that the shape of the cantilever 21 is not limited to this. When the locking clip 2101 is lifted, the cantilever 21 can be attached to the fastener 10 as any structure.

The unlocking member 20 defines a socket 211 between the cantilever 21 and the unlocking block 22. The socket 211 faces the opening 125. The connector 200 extends into the opening 125 and the socket 211.

The unlocking block 22 is adapted to the locking clip 2101 to lift or release the locking clip 2101 during the rotation of the cantilever 21.

The unlocking member 20 further includes two pivot posts 23 respectively provided on two outer walls of the unlocking member 20 adjacent to the unlocking block 22. The pivot posts 23 are received in the connecting holes 1211. The unlocking member 20 rotates about the pivot posts 23 as an axis. It should be noted that the structure of the pivot posts 23 is not limited. In other embodiments, the pivot posts 23 may be long and straight cylinders extending out of the connecting holes 1211.

Figure 4:
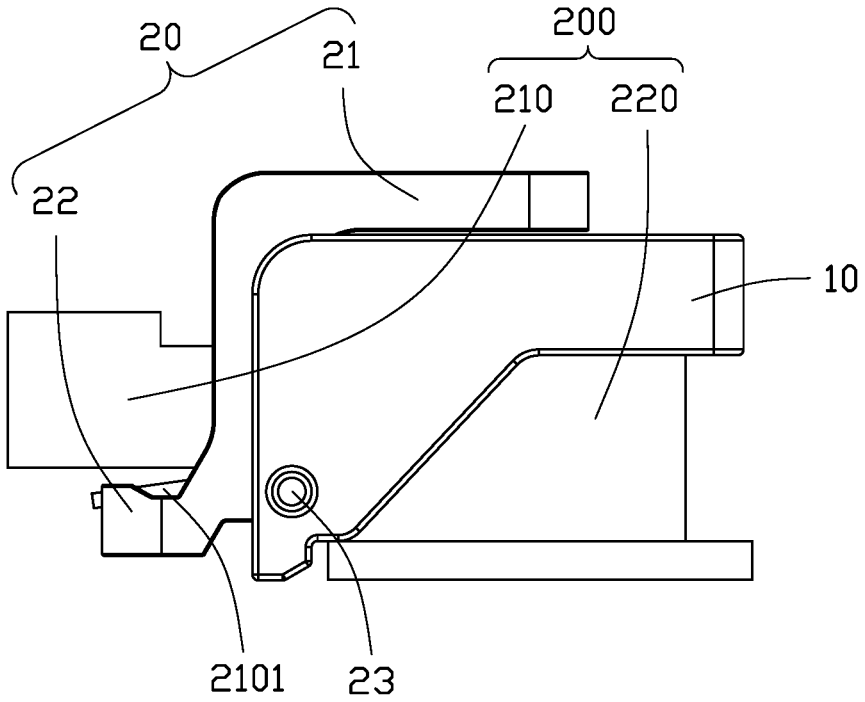
FIG. 4 is a schematic diagram of an unlocked state of the unlocking bracket and the connector.

Referring to FIG. 3 and FIG. 4, the connector 200 includes a first plug 210 and a second plug 220. A locking clip 2101 is provided on the first plug 210. The first plug 210 extends into the second plug 220 and is locked with the second plug 220 or detached from the second plug 220 by the locking clip 2101. In one embodiment, the connector 200 is a cable connector.

During operation, the support rod 11 is abutted on the bottom of the second plug 220. The fastener 10 is rotated about the support rod 11 until the fixing case 12 is sleeved on the second plug 220. At this time, the fastener 10 is fixed to the second plug 220 is fixed, and the second plug 220 extends out of the opening 125.

To lock the connector 200, the first plug 210 is passed through the socket 211 and the opening 125 and is inserted into the second plug 220, and the locking clip 2101 pushes the unlocking block 22 to rotate about the pivot posts 23, such that the cantilever 21 tilts upward and there is a gap between the cantilever 21 and the fastener 10, and the unlocking block 22 tilts downward and bears on the locking clip 2101. At this time, the connector 200 is locked.

To unlock the connector 200, the cantilever 21 is pressed, so that the unlocking member 20 rotates about the pivot posts 23, the cantilever 21 moves downward to attach to the fastener 10, and the unlocking block 22 lifts the locking clip 2101 upward to unlock the first plug 210 and the second plug 220. At this time, the connector 200 is unlocked, and the first plug 210 can be removed.

Second Embodiment

Figure 5:
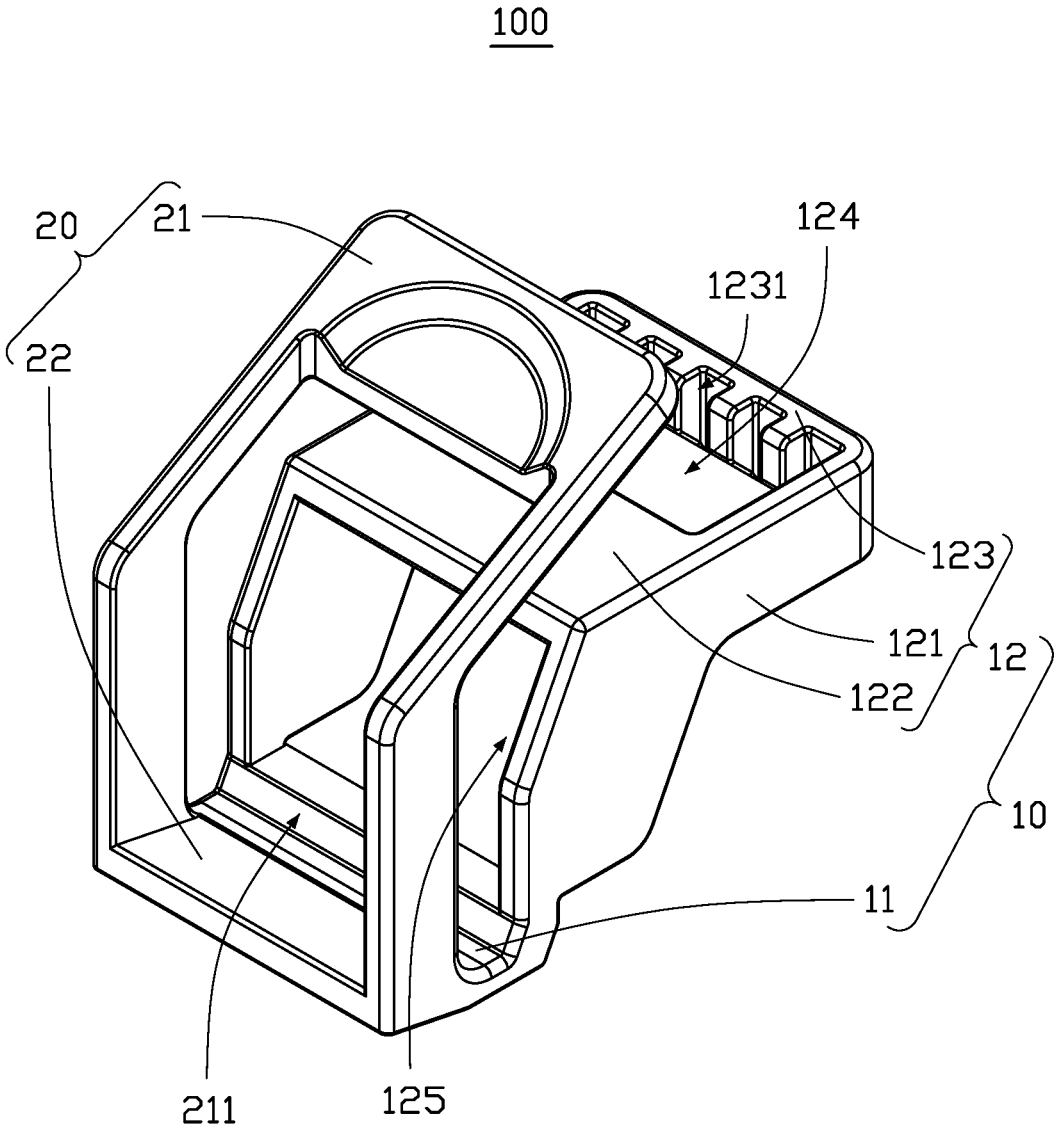
FIG. 5 is a schematic perspective view of an unlocking bracket according to a second embodiment.

FIG. 5 shows a second embodiment of the unlocking bracket 100. The second embodiment is substantially the same as the first embodiment, except that the fastener 10 and the unlocking member 20 are integrally formed and made of elastic material. It should be noted that the above-mentioned elastic material includes, but is not limited to, nylon, elastic resin, and the like.

Figure 6:
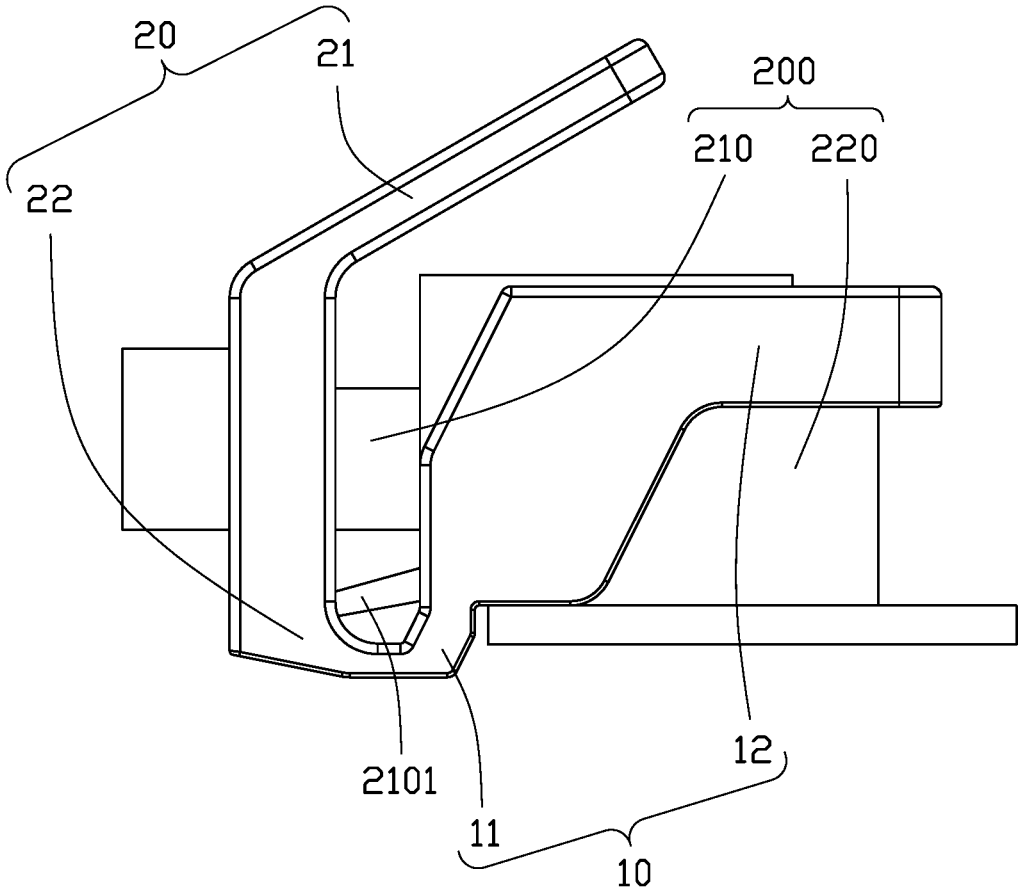
FIG. 6 is a schematic diagram of a locked state of the unlocking bracket and a connector.
Figure 7:
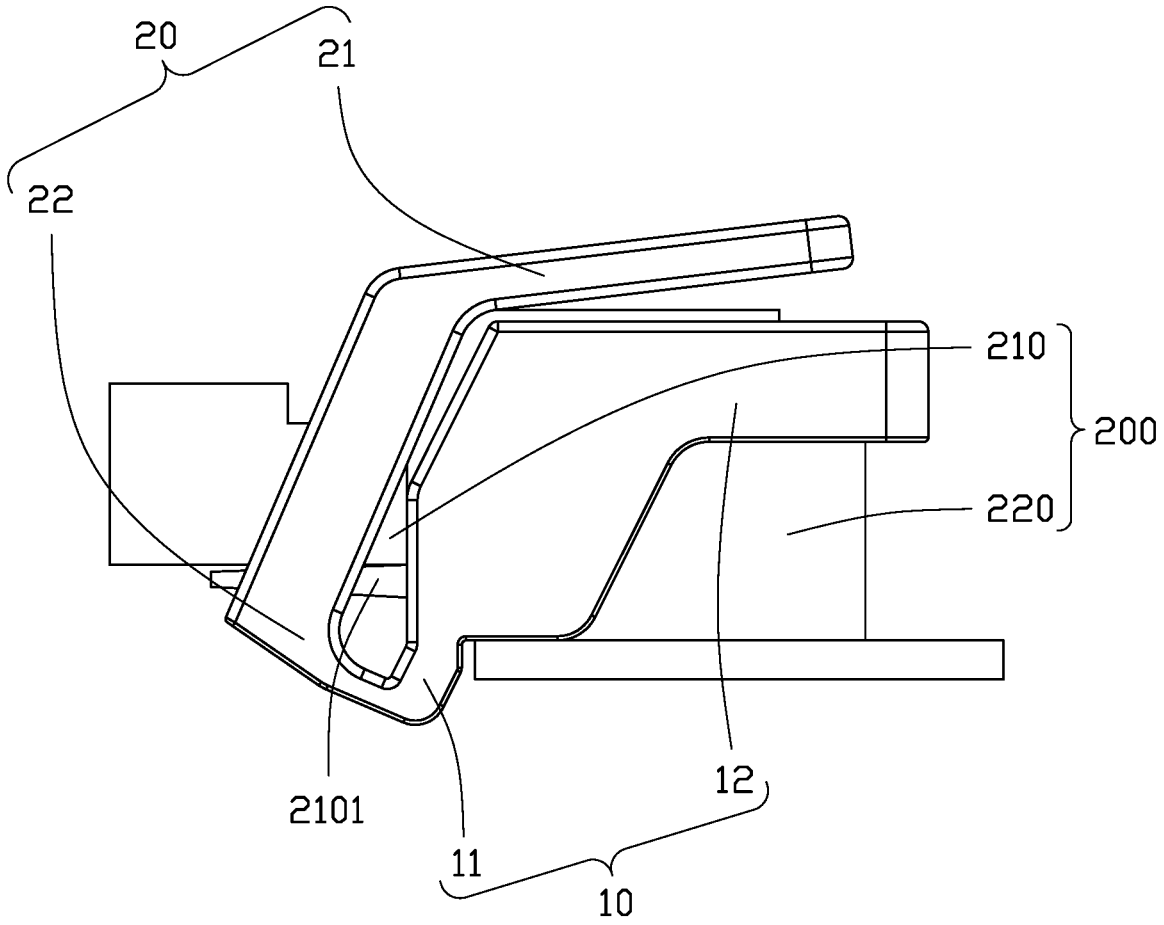
FIG. 7 is a schematic diagram of an unlocked state of the unlocking bracket and the connector.

Referring to FIG. 6 and FIG. 7, to lock the connector 200, the first plug 210 is directly inserted through the socket 211 and the opening 125 into the second plug 220, and the locking clip 2101 bears against the unlocking block 22. At this time, the connector 200 is locked.

To unlock the connector 200, the cantilever 21 is pressed, the unlocking block 22 is deformed, and the locking clip 2101 is lifted upward. At this time, the connector 200 is unlocked, and the first plug 210 can be removed from the second plug 220. After the first plug 210 is removed, the unlocking block 22 returns to an original state under a restoring force.

The unlocking bracket 100 fixes the fastener 10 to the second plug 220, and is provided with the unlocking member 20 that is rotationally connected to the fastener 10. The cantilever 21 is located above the fastener 10. The connector 200 can be unlocked simply by pressing the cantilever 21 above the connector 200. Thus, a process of unlocking the connector 200 is simple and easy to operate.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An unlocking bracket for locking and unlocking a connector, the unlocking bracket comprising:

a fastener comprising a fixing case and a support rod provided on the fixing case, the support rod configured to bear on the connector, and the fixing case configured to sleeve on the connector; and an unlocking member comprising a cantilever and an unlocking block, the cantilever configured to be rotationally mounted on the fixing case, the unlocking block configured to abut a locking clip of the connector; wherein:

the fastener and the unlocking member are integrally formed, the cantilever is configured to drive the unlocking block to rotate to push the locking clip.

2. The unlocking bracket of claim 1, wherein:

the unlocking member defines a socket; and the connector is configured to extend through the socket.

3. The unlocking bracket of claim 1, wherein:

the fixing case defines a latching slot; and the connector is configured to be latched in the latching slot.

4. The unlocking bracket of claim 3, wherein:

the fixing case defines an opening communicating with the latching slot.

5. The unlocking bracket of claim 1, wherein:

the fixing case comprises two side plates, a limiting plate, and a fixing block;

the two side plates are respectively provided on two ends of the support rod;

the limiting plate is fixed between the two side plates; and the fixing block is fixed on ends of the two side plates.

6. The unlocking bracket of claim 5, wherein:
each side plate defines a connecting hole;
the unlocking member comprises pivot posts; and
the pivot posts are received in the connecting holes.

7. The unlocking bracket of claim 5, wherein:
a plurality of anti-slip grooves is equidistantly defined in a side of the fixing block facing the limiting plate.

8. The unlocking bracket of claim 1, wherein:
the fastener and the unlocking member are made of elastic material.

* * * * *